US012781407B2

(12) United States Patent
Liu et al.

(10) Patent No.: US 12,781,407 B2
(45) Date of Patent: Nov. 3, 2026

(54) CONTROL METHOD FOR WASHING MACHINE AND WASHING MACHINE

(71) Applicants: QINGDAO HAIER WASHING MACHINE CO., LTD., Shandong (CN); HAIER SMART HOME CO., LTD., Shandong (CN)

(72) Inventors: Kai Liu, Shandong (CN); Sheng Xu, Shandong (CN); Yanfen Lv, Shandong (CN); Zhilong Zhao, Shandong (CN)

(73) Assignees: QINGDAO HAIER WASHING MACHINE CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 114 days.

(21) Appl. No.: 18/847,879

(22) PCT Filed: Feb. 14, 2023

(86) PCT No.: PCT/CN2023/075835

§ 371 (c)(1),
(2) Date: Sep. 17, 2024

(87) PCT Pub. No.: WO2023/173979

PCT Pub. Date: Sep. 21, 2023

(65) Prior Publication Data

US 2025/0207313 A1 Jun. 26, 2025

(30) Foreign Application Priority Data

Mar. 18, 2022 (CN) ..... 202210271485.2

(51) Int. Cl.

| | |
|---|---|
| ***D06F 33/36*** | (2020.01) |
| ***D06F 33/38*** | (2020.01) |
| ***D06F 39/08*** | (2006.01) |
| ***D06F 39/10*** | (2006.01) |
| *D06F 105/06* | (2020.01) |

(52) U.S. Cl.
CPC ..... *D06F 33/36* (2020.02); *D06F 33/38* (2020.02); *D06F 39/083* (2013.01); *D06F 39/10* (2013.01); *D06F 2105/06* (2020.02)

(58) Field of Classification Search
CPC ..... D06F 33/36; D06F 33/38; D06F 39/083; D06F 39/10; D06F 2105/06
(Continued)

(56) References Cited

U.S. PATENT DOCUMENTS

| | | | | |
|---|---|---|---|---|
| 3,684,096 A | | 8/1972 | Kretchman | |
| 5,493,745 A | * | 2/1996 | Hauch | D06F 39/083 68/18 F |

(Continued)

FOREIGN PATENT DOCUMENTS

| | | |
|---|---|---|
| CN | 1427115 A | 7/2003 |
| CN | 101705596 A | 5/2010 |

(Continued)

OTHER PUBLICATIONS

International Search Report (PCT/ISA/210) with translation and Written Opinion (PCT/ISA/237) mailed on Jun. 5, 2023, by the China National Intellectual Property Administration (ISA/CN) as the International Searching Authority for International Application No. PCT/CN2023/075835. (11 pages).

*Primary Examiner* — Tinsae B Ayalew
(74) *Attorney, Agent, or Firm* — Buchanan Ingersoll & Rooney PC

(57) ABSTRACT

A washing machine includes: a water holding barrel, a circulation filtration pipeline connected with the water holding barrel, and a circulation pump arranged in the circulation filtration pipeline, and a filter device arranged between the circulation pump and a water outlet of the circulation filtration pipeline. A sewage pipeline is connected to the sewage outlet of the filter device. The washing machine alternately executes a circulation filtration operation and a (Continued)

sewage discharge operation, and the circulation pump provides power for the filter device to discharge sewage, so that the filtered impurities in the filter device can be timely and fully discharged.

13 Claims, 5 Drawing Sheets

(58) Field of Classification Search
USPC ..... 68/3 R
See application file for complete search history.

(56) References Cited

U.S. PATENT DOCUMENTS 10,604,884 B2 3/2020 Hao et al.
2014/0298590 A1* 10/2014 Fulmer ..... D06F 39/10 68/18 F
2018/0112346 A1 4/2018 Hao et al.

FOREIGN PATENT DOCUMENTS

| | | | |
|---|---|---|---|
| CN | 103938416 | A | 7/2014 |
| CN | 104975475 | A | 10/2015 |
| CN | 106149280 | A | 11/2016 |
| CN | 106381646 | A | 2/2017 |
| CN | 109957924 | A | 7/2019 |
| CN | 110952265 | A | 4/2020 |
| CN | 111676669 | A | 9/2020 |
| CN | 112914464 | A | 6/2021 |
| CN | 113136682 | A | 7/2021 |
| DE | 102015216581 | A1 | 3/2017 |
| JP | 2020081056 | A | 6/2020 |

* cited by examiner

CONTROL METHOD FOR WASHING MACHINE AND WASHING MACHINE

FIELD

The application belongs to the field of laundry apparatus, and specifically relates to a control method for a washing machine and a washing machine.

BACKGROUND

During the washing process of the laundry by the washing machine, the lint is produced from the laundry fall into the washing water due to the friction between the laundry and between the laundry and the washing machine. If the lint in the washing water cannot be removed, the lint is likely to adhere to the surface of the laundry after washing, so the washing effect of the laundry is affected. For this reason, a filter for filtering lint is installed on the existing washing machine. Washing water passes repeatedly through the filter during the washing process to remove lint from the washing water.

The filter of the existing washing machine is generally arranged inside the inner barrel or the drain pump, and is used to filter out lint and sundries in the washing water. However, after the washing machine has been used for a long time, the filter is filled with lint and debris, which will affect the filtering effect of the filter, cause the drain valve/drain pump to be blocked, and easily breed bacteria. So the filter needs to be cleaned in time, otherwise the washing water is polluted to cause the laundry to be subject to secondary pollution and affect the health of users. However, the filter of most washing machines needs to be taken out for being cleaned manually by the user, which is inconvenient to operate.

Therefore, a filter device with a self-cleaning function provided in the prior art can automatically remove filter impurities such as lint attached inside after completing the filtration process, and the filtered impurities is discharged along water flow. However, in consideration of the internal space of a washing machine, a path for discharging the sewage out of the filter device to the outside is relatively long, and there may be a certain height difference. So it is difficult for the sewage in the filter device to be fully discharged without a driving force, the filtered impurities is continuously accumulated in the filter device, and there is the problem of bacterial growth caused by long-term use.

On the other hand, for most washing machines, a filter device is cleaned and the sewage is discharged after a washing process or a rinsing process is completed, or even after one entire washing program of a washing machine is completed. When lint content in water is large, the filtered impurities may cover the screen of the filter device, so the filtration efficiency of filtering impurities is affected. In severe cases, the filter device may be blocked by filtered impurities, and the circulating filtration cannot continue to be carried out, affecting user's experience.

In view of this, the present application is proposed.

SUMMARY

The present application is to overcome the shortcomings of the existing technology and provide a method for controlling a washing machine in which the sewage in a filter device is driven to be drained, and the sewage is driven to be multiply drained out of the a filter device during a washing/rinsing process by a circulation pump, and a washing machine.

In order to solve the above technical problems, the basic concepts of the technical solutions adopted by the present application are as follows.

A washing machine includes:

- a water holding barrel,
- a circulation filtration pipeline, of which a water inlet and a water outlet are connected with the water holding barrel respectively, and in which a circulation pump is arranged;
- a filter device, arranged between the circulation pump and the water outlet of the circulation filtration pipeline, and having the sewage outlet for draining sewage outwards; and
- a sewage pipeline, connected with the sewage outlet of the filter device.

A control method for a washing machine includes: a circulation filtration operation and a discharge operation are alternately executed in a washing process and a rinsing process.

The circulation filtration operation includes: closing the sewage outlet of the filter device and/or cutting off the sewage pipeline, and running the circulation pump to circulate and filter water in the water holding barrel.

The sewage discharge operation includes: opening the sewage outlet of the filter device and/or connecting the sewage pipeline, running the circulation pump to drive the sewage in the filter device to drain into the sewage pipeline.

As an embodiment, during the sewage discharge operation, the circulation pump is configured to continue to run for a time, and then the circulation filtration operation is executed.

The filter device includes:

- a filter chamber, on which a water inlet, a filtered water outlet and a sewage outlet are arranged;
- a filter mechanism, rotatably arranged in the filter chamber; and
- a driving mechanism, for driving the filter mechanism to rotate in the filter chamber.

The sewage discharge operation also includes: during an operation of the circulation pump, turning on the driving mechanism to drive the filter mechanism to rotate in the filtering chamber.

As an embodiment, the circulation filtration operation includes:

- S1. closing the sewage outlet of the filter device and/or cutting off the sewage pipeline;
- S2. turning on the circulation pump and continuing running for a time;
- S3. turning off the circulation pump and stopping running for a time;
- S4. if the number of times for executing step S2 reaches a preset number of times in the circulation filtration operation, finishing the circulation filtration operation; if not, returning to step S2.

Optionally, in step S2, the circulation pump continues running for a third preset time $T_3$. In step S3, the circulation pump is turned off and kept being closed for a second preset time $T_2$. The third preset time $T_3$ is greater than the second preset time $T_2$.

As an embodiment, the filter device includes:

- a filter chamber, on which a water inlet, a filtered water outlet and a sewage outlet are arranged, wherein the water inlet and the filtered water outlet are respectively connected with the circulation filtration pipeline;

a filter mechanism, rotatably arranged in the filter chamber; and a driving mechanism, for driving the filter mechanism to rotate in the filter chamber.

In Step S3, in a closing state of the circulation pump, the driving mechanism is turned on to drive the filter mechanism to rotate in the filter chamber.

Further, during the sewage discharge operation, the driving mechanism is turned on in an operation of the circulation pump to drive the filter mechanism to continue rotating in the filtering chamber for the first preset time $T_1$.

In step S3, the driving mechanism is configured to drive the filter mechanism to continuously rotate in the filter chamber for a second preset time $T_2$; and the second preset time $T_2$ is shorter than the first preset time $T_1$.

As an embodiment, the washing machine further includes an external drainage pipeline for draining water to the outside. An inlet end of the external drainage pipeline is connected to the circulation filtration pipeline between the circulation pump and the filter device, and one of the filter device and the external drainage pipeline is connected with the circulation pump.

During the washing/rinsing process, the filter device is connected with the circulation pump.

After the washing/rinsing process is completed, the washing machine executes the sewage discharge operation. After the sewage discharge operation is completed, the circulation pump is connected with the external drainage pipeline, and the circulation pump runs to drive water in the water holding barrel to be drained out of the washing machine through the external drainage pipeline.

Further, before water is supplied for washing/rinsing process, the circulation pump and filter device are connected; water is fed into the water holding barrel, and the circulation filtration operation is executed. After the circulation filtration operation is completed, the sewage discharge operation is executed. The circulation filtration operation and the sewage discharge operation are executed alternately, until the washing/rinsing process is completed.

Another object of the present application is to provide a washing machine that performs the above control method of the washing machine.

A washing machine also includes a recovery device connected with the sewage discharge pipeline. During the sewage discharge operation, the circulation pump is configured to run to drive the sewage in the filter device to be drained into the recovery device through the sewage discharge pipeline.

Through the above technical solutions, the present application has the following advantages compared with the prior art.

In the present application, the circulation filtration of a washing machine needs to be realized by a circulation pump. The circulation pump can also be used for driving sewage to be drained out of the filter device, without adding other power, so the sewage carrying the filtered impurities is fully drained out of the filter device during the sewage discharge operation. It is reduced in the residue of the filtered impurities. At the same time, the washing machine alternately executes the circulation filtration operation and the sewage discharge operation during the washing/rinsing process, and the filtered impurities remaining inside the filter device can be timely drained during the circulation filtration operation, so it is avoided that the filtered impurities is accumulated inside the filter device to affect the filtration efficiency.

In the present application, the filter mechanism of the filter device is controlled to continuously rotate during the sewage discharge operation, so that the filtered impurities attached to the surface of the filter mechanism are peeled off by centrifugal force. At the same time, in conjunction with the driving force provided by the circulation pump, it is improved in removing the filtered impurities in the filter device.

In the present application, the end of the sewage pipeline is connected with the recovery device for receiving the sewage discharged from the filter device, preventing the sewage containing the filtered impurities such as lint from being directly discharged from the washing machine. Thereby microplastics in the filtered impurities are prevented from entering the ecological environment along the water flow, and from affecting the ecological environment and human health.

Specific embodiments of the present application are described in further detail below with reference to the accompanying drawings.

DESCRIPTION OF THE DRAWINGS

The accompanying drawings, as a part of the present application, are used to further understand the present application. The embodiments of the present application and their descriptions are used to explain the present application, but do not improperly limit to the present application. Apparently, the drawings in the following description are only some embodiments, and those skilled in the art can also obtain other drawings according to these drawings without creative efforts. In the figures.

Figure 1:
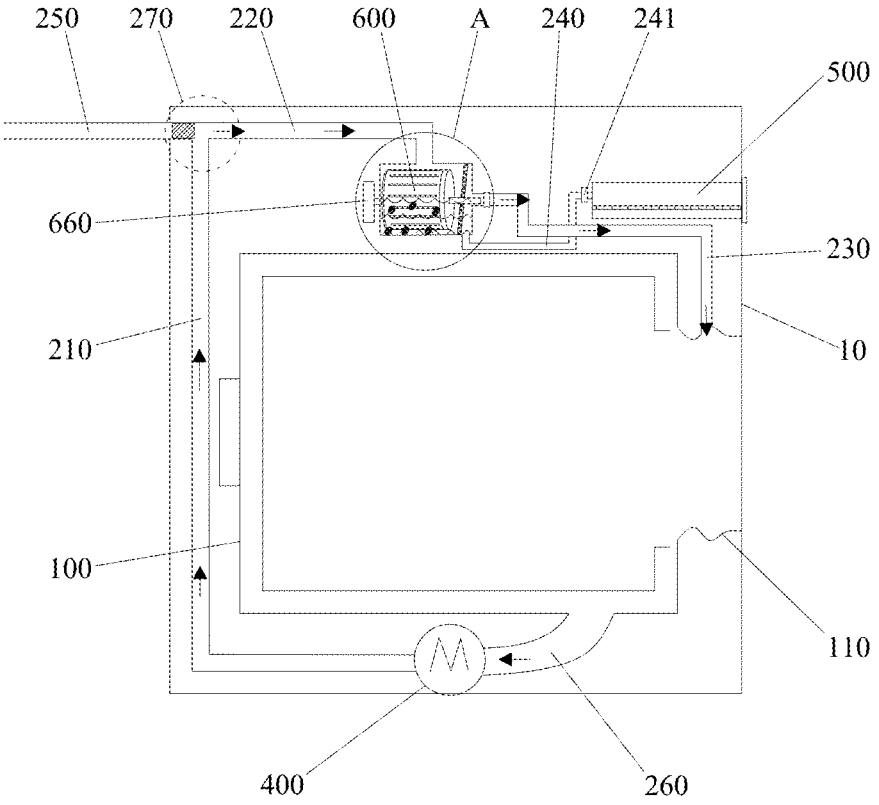
FIG. 1 is a structural diagram of a washing machine (circulating filtration process) in an embodiment of the present application.
Figure 2:
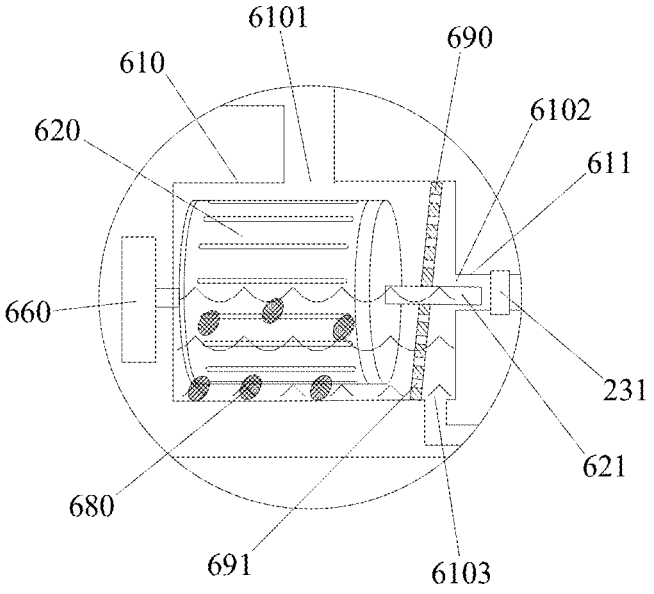
FIG. 2 is an enlarged diagram of position A in FIG. 1 of the present application.
Figure 3:
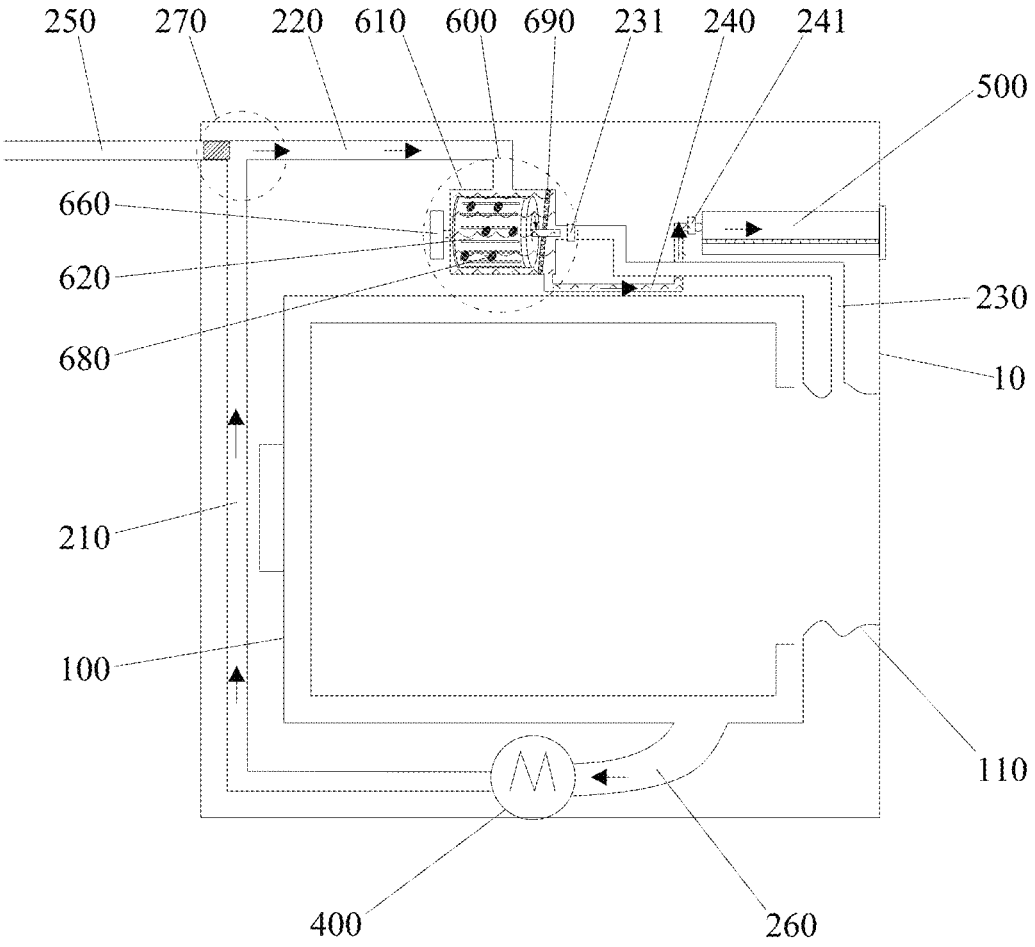
FIG. 3 is a structural diagram of a washing machine (sewage drainage process) in an embodiment of the present application.
Figure 4:
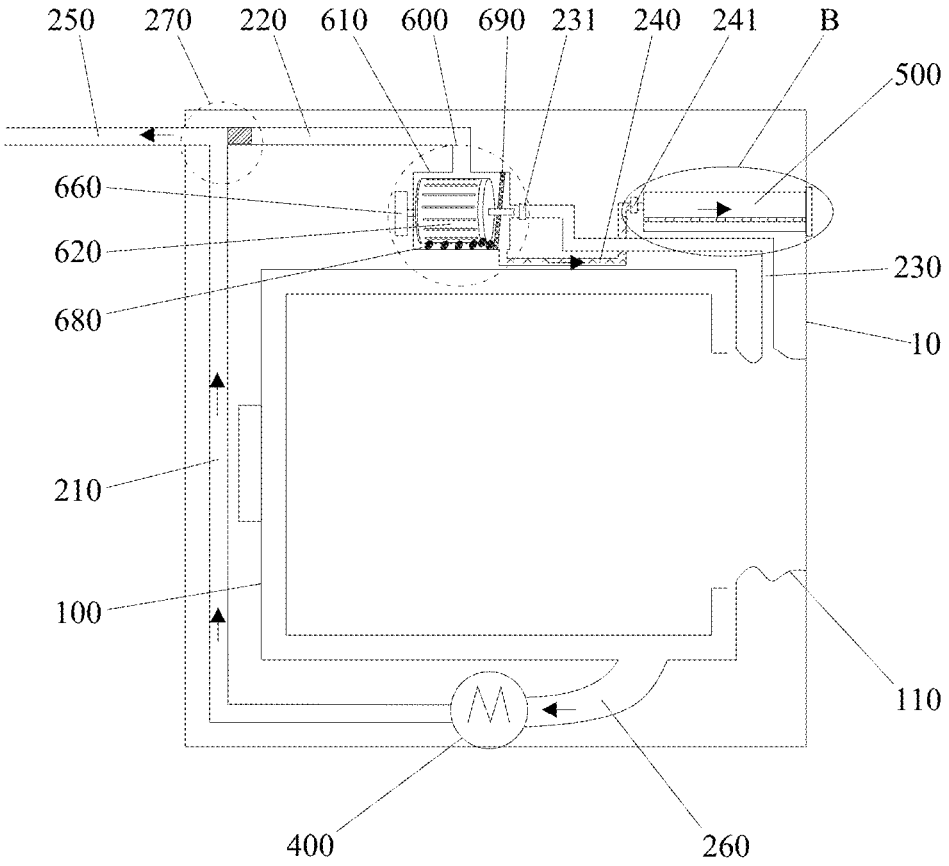
FIG. 4 is a schematic diagram of a washing machine (drainage process) in an embodiment of the present application.
Figure 5:
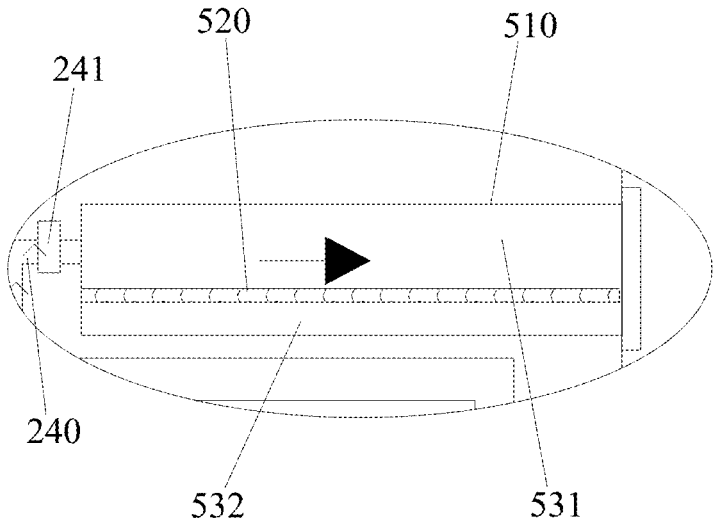
FIG. 5 is an enlarged diagram of place B in FIG. 4 of the present application.

In the picture: 10. Case; 100. Water holding barrel; 110. Window pad; 210. Drainage pipeline; 220. Circulation pipeline; 230. Return water pipeline; 231. Return water control valve; 240. Sewage pipeline; 241. Sewage control valve; 250. External drainage pipeline; 260. Drainage pipe of a water holding barrel; 270. Switching device; 400. Circulation pump; 500. Recovery device; 510. Housing; 520. Filter component; 531. First chamber; 532. Second chamber; 600. Filter device; 601. First limiting surface; 602. Second limiting surface; 603. Third limiting surface; 604. Fourth limiting surface; 605. Fifth limiting surface; 606. Sixth limiting surface; 610. Filter chamber; 6101. Water inlet; 6102. Filtered water outlet; 6103. Sewage outlet; 6104. Installation port; 611. Sealing support part; 612. Sleeve part; 613. Reinforcing rib; 620. Filter mechanism; 621. Water outlet joint; 622. Rotation support part; 623. Filter support part; 624. Motor installation part; 625. Filter screen; 631. First bearing; 632. Second bearing; 641. First sealing member;

642. Second sealing member; 643. Third sealing member; 650. Filter chamber flange; 651. Connection part; 652. Insertion part; 653. Through-opening; 660. Driving mechanism; 680. Cleaning particles; 690. Baffle; 691. Water hole.

It should be noted that these drawings and descriptions are not intended to limit the scope of the present application in any way, but illustrate the concept of the present application for those skilled in the art by referring to specific embodiments.

DETAILED DESCRIPTION

In order to make objects, technical solutions and advantages of the embodiments of the present application clearer, the solutions in the embodiments are clearly and completely described as follows in combination with accompanying drawings in the embodiments of the present application. The following embodiments are used for illustrating the present application, rather than limiting the scope of the present application.

In the description of the present application, it should be noted that, the orientation or positional relationship indicated by such terms as "up", "down", "front", "rear", "left", "right", "vertical", "inner" and "outer" refers to the orientation or positional relationship based on the accompanying drawings. Such terms are merely used for conveniently and simplified describing the present application, rather than indicating or implying that the device or element referred to must be located in a certain orientation or must be constructed or operated in a certain orientation. Therefore, the terms cannot be understood as a limitation to the present application.

In the description of the present application, it should be noted that, unless otherwise stipulated and defined definitely, such terms as "installed", "connected" and "in connection" should be understood in their broad sense. For example, the connection can be a fixed connection, a detachable connection or an integral connection; can be mechanical connection or electrical connection; and can be direct connection, or indirect connection through an intermediate. For those skilled in the art, specific meanings of the above terms in the present application can be understood according to specific conditions.

Embodiment 1

As shown in FIGS. 1 to 5, a washing machine in the embodiment includes:

- a water holding barrel 100,
- a circulation filtration pipeline, of which a water inlet and a water outlet are connected with the water holding barrel 100 respectively, and in which a circulation pump 400 is arranged;
- a filter device 600, arranged between the circulation pump 400 and the water outlet of the circulation filtration pipeline, and having a water inlet 6101, a filtered water outlet 6102 and a sewage outlet 6103, wherein, the water inlet 6101 and the filtered water outlet 6102 are connected to the circulation filtration pipeline, and the sewage outlet 6103 is used for draining sewage to the outside; and
- a sewage pipeline 240, connected with the sewage outlet 6103 of the filter device 600 for receiving sewage drained from the sewage outlet 6103.

Specifically, the filter device 600 includes:

- a filter chamber 610, on which a water inlet 6101, a filtered water outlet 6102 and a sewage outlet 6103 are arranged;
- a filter mechanism 620, rotatably arranged in the filter chamber 610; and a driving mechanism 660, for driving the filter mechanism 620 to rotate in the filter chamber 610.

The filter mechanism 620 divides an interior of the filter chamber 610 into an outer chamber and an inner chamber. The water inlet 6101 is connected with the outer chamber, and the filtered water outlet 6102 is connected with the inner chamber. Water in the water holding barrel 100 flows into the outer chamber through the water inlet 6101, flows into the inner chamber through the filter mechanism 620 to be filtered, and flows out from the filtered water outlet 6102. The filtered impurities such as lint in water are attached onto an outer wall of the filter mechanism 620.

The circulation filtration pipeline in the embodiment specifically includes:

- a drainage pipe 260 of a water holding barrel, connected with the water holding barrel 100 and an inlet end of the circulation pump 400;
- a drainage pipeline 210, of which one end is connected with an outlet end of the circulation pump 400;
- a circulation pipeline 220, of which one end is connected with the drainage pipeline 210, and another end is connected with the water inlet 6101 of the filter device 600; and
- a return water pipeline 230, of which one end is connected with the filtered water outlet 6102 of the filter device 600 and another end is connected with the water holding barrel 100 for delivering the filtered water to the water holding barrel 100.

In the embodiment, the return water pipeline 230 is specifically connected with the window pad 110 at an opening of the water holding barrel 100.

A washing machine of the embodiment also includes an external drainage pipeline 250 for draining water to the outside of the washing machine. An inlet end of the external drainage pipeline 250 is connected to the circulation filtration pipeline between the circulation pump 400 and the filter device 600, and one of the filter device 600 and the external drainage pipeline 250 is connected with the circulation pump 400.

Specifically, the drainage pipeline 210 is connected with the circulation pipeline 220 through a switching device 270. The switching device 270 includes:

- a water inlet, connected with the outlet end of the circulation pump 400;
- a first water outlet, connected with the filter device 600;
- a second water outlet, connected with the external drainage pipeline 250; and
- a switching mechanism, used for controlling one of the first water outlet and the second water outlet to connected with the water inlet.

It is achieved that one of the filter device 600 or the external drainage pipeline 250 is connected with the circulation pump 400 by controlling the action of the switching mechanism.

In the embodiment, a sewage control valve 241 be capable of be opened and closed is provided in the sewage pipeline 240. Preferably, a return water control valve 231 is also provided in the return water pipeline 230.

When the filter device 600 is connected with the circulation pump 400 by the switching device 270, the return water control valve 231 is opened to conduct the return water pipeline 230, and the sewage control valve 241 is closed at the same time, so that water in the water holding barrel 100 can flow into the filter device 600 to be filtered and return to the water holding barrel 100 through the return water pipeline 230 after being filtered. The sewage control valve 241 is opened and the return water control valve 231 is closed at the same time, so the sewage in the filter device 600 can be drained into the sewage pipeline 240 through the sewage outlet 6103.

In the embodiment, a washing machine alternately performs a circulation filtration operation and a sewage discharge operation during the washing/rinsing processes.

The circulation filtration operation includes: closing the sewage control valve 241 to cut off the sewage pipeline 240, and running the circulation pump 400 to circulate and filter the water in the water holding barrel 100.

The sewage discharge operation includes: opening the sewage control valve 241 to open the sewage pipeline 240, and running the circulation pump 400 to drive the sewage in the filter device 600 to drain into the sewage pipeline 240.

In the above solutions, by alternately performing the circulation filtration operation and the sewage discharge operation during the washing/rinsing processes of a washing machine, the filtered impurities such as lint remaining inside the filter device 600 during the circulation filtration process can be discharged timely. Thereby the filtered impurities is prevented from being accumulated in the filter device 600, affecting the filtration efficiency. Especially when the content of filtered impurities such as lint in water is high, the filtered impurities is effectively prevented from excessively accumulating to block the filter device 600 by the solution of the embodiment, in comparison with a method of continuously performing the circulation filtration operation until the washing/rinsing process ends.

At the same time, the circulation pump 400 is controlled to run to provide a force for discharging sewage in the filter device 600, so the sewage in the filter device 600 can be fully discharged. The sewage in the filter device 600 is prevented from being abundantly remained when the outlet end of the sewage pipeline 240 is higher than the sewage outlet 6103, so the filtered impurities remaining in the filter device 600 is reduced. Since the circulation filtration operation of a washing machine needs to be realized by the circulation pump 400, in the solution of this embodiment, the sewage in the filter device 600 is driven to be discharged by the circulation pump 400 without additional power. Thus a space for setting up an additional driving device is saved, and the production cost is also saved.

In another solution of the embodiment, a sewage control valve be capable of being opened and closed can also be provided at the sewage outlet of the filter device, and the sewage control valve is no longer provided in the sewage pipeline. At this time, during the circulation filtration operation, the sewage outlet of the filter device can be closed by closing the sewage control valve, and water flowing into the filter device can flow back into the water holding barrel. During the sewage discharge operation, the sewage outlet of the filter device is opened by opening the sewage control valve, and sewage in the filter device can be discharged into the sewage pipeline.

In a further solution of the embodiment, during the sewage discharge operation, the circulation pump 400 is configured to continue to run for a first preset time $T_1$, and then perform the circulation filtration operation.

Further, the sewage discharge operation also includes: during an operation of the circulation pump 400, turning on the driving mechanism 660 to drive the filter mechanism 620 to continue rotating in the filtering chamber 610 for the first preset time $T_1$.

In the above solution, during a sewage discharge operation executed by a washing machine, both the circulation pump 400 and the driving mechanism 660 are kept being open at the same time. By controlling the filter mechanism 620 to rotate at a high speed in the filter chamber 610, the filtered impurities attached to the surface of the filter mechanism 620 can be thrown onto the inner wall of the filter chamber 610 under the centrifugal force, and then be mixed into the water flow in the filter chamber 610 and discharged through the sewage outlet 6103 along the water flow. Thus the filtered impurities are prevented from being too firmly attached onto the filter mechanism 620, and not being fully discharged.

In a further solution of the embodiment, the circulation pump 400 is controlled to be turned on intermittently the washing machine during a circulation filtration operation. Specifically, the circulation filtration operation includes:

S1. closing the sewage control valve 241 to cut off the sewage pipeline 240;

S2. turning on the circulation pump 400 and continuing running for a certain time;

S3. turning off the circulation pump 400 and stopping running for a certain time;

S4. if the number of times for executing step S2 reaches a preset number of times in the circulation filtration operation, finishing the circulation filtration operation; if not, returning to step S2.

In the above solution, the circulation pump 400 is turned on intermittently. In a period of the circulation pump 400 being closed, water in the water holding barrel 100 does not flow through the filter device 600, and the filtered impurities attached to the surface of the filter mechanism 620 can be peeled off and mixed into water. The filtered impurities is discharged along the water flow during the sewage operation. So it is avoided the problem that the water flow is filtered through the filter device 600 for too long time, the problem causes the filtered impurities to attach too firmly inside the filter device 600 and not to be fully discharged even by rotating the filter mechanism 620 during the sewage discharge operation.

It can be understood, the filtered impurities can be prevented from being too firmly attached on the filter device by increasing an alternating frequency of executing the circulation filtration operation and the sewage discharge operation. However, the circulation filtration operation and the sewage discharge operation are alternately executed by opening and closing the sewage control valve 241 frequently. The service life of the sewage control valve 241 is shortened due to too frequently switching the state.

Further, step S3 also includes: in a closing state of the circulation pump 400, the driving mechanism 660 is turned on to drive the filter mechanism 620 to rotate in the filter chamber 610.

In a closing state of the circulation pump 400, the filter mechanism 620 is configured to rotate to stir the water flow in the filter chamber 610, so that the filtered impurities attached onto the outer surface of the filter mechanism 620 is peeled off under the dual actions of the centrifugal force and the agitated water flow, and mixed into water in the filter chamber 610. It facilitated that the filtered impurities attached onto the outer surface of the filter mechanism 620 is fully peeled off.

Further, in step S2, the circulation pump 400 continues running for a third preset time $T_3$. In step S3, the circulation pump 400 is turned off and kept being closed for the second preset time $T_2$, that is, the driving mechanism 660 is configured to drive the filter mechanism 620 to continue rotating in the filter chamber 610 for the second preset time $T_2$. The third preset time $T_3$ is greater than the second preset time $T_2$.

In the above solutions, the filter mechanism 620 includes a filter screen for implementing the filtering function through holes of the filter screen. The specific values of the second preset time $T_2$ and the third preset time $T_3$ can be obtained in advance through a large number of experiments and directly written into a control program of a washing machine. The third preset time $T_3$ specifically refers to a time when most of the holes on the filter screen are covered by the filtered impurities after filter device 600 is configured to continue filtering. It is ensured that the filtered impurities attached onto the filter mechanism 620 are fully peeled off for the second preset time $T_2$.

The third preset time $T_3$ is greater than the second preset time $T_2$. The filter mechanism 620 is not clogged by the filtered impurities, water in the water holding barrel 100 can be fully filtered during the washing/rinsing process, which is helpful to improve the laundry cleaning effect.

It should be noted, when a sewage control valve is provided at the sewage outlet of the filter device and there is no sewage control valve arranged in the sewage pipeline, the circulation filtration operation includes the following steps:

S1'. closing the sewage control valve to close the sewage outlet of the filter device;

S2'. turning on the circulation pump and keep running for a certain time;

S3'. turning off the circulation pump and keeping being closed for a certain time;

S4'. if the number of times for executing step S2' reaches a preset number of times in the circulation filtration operation, finishing the circulation filtration operation; if not, returning to step S2'.

In a further solution of the embodiment, in a circulation filtration operation, the filter mechanism 620 continuously rotates in the filter chamber 610 for a second preset time $T_2$ in step S3. In a sewage discharge operation, the filter mechanism 620 continuously rotates in the filter chamber 610 for a first preset time $T_1$. The second preset time $T_2$ is shorter than the first preset time $T_1$.

In the above solutions, each rotation of the filter mechanism 620 is used to prevent the filtered impurities from being too firmly attached in the circulation filtration operation, and the rotation of the filter mechanism 620 needs to ensure that the filtered impurities is fully peeled off in the sewage discharge operation. In the sewage discharge operation, the filter mechanism 620 is configured to rotate for a longer time, which is beneficial to ensuring that there are almost no filter impurities attached to the surface of the filter mechanism 620 when the next circulation filtration operation is executed.

In a solution of the embodiment, during the washing/rinsing process, the circulation pipeline 220 and the drainage pipeline 210 are switched to be connected with the filter device 600 and the circulation pump 400 by the switching device 270, so that the circulation filtration operation and the sewage discharge operation are alternately executed. After the washing/rinsing process is completed, that is, when the drainage process is executed, the washing machine first performs a sewage discharge operation. Specifically, the sewage control valve 241 is opened, the filter mechanism 620 is driven to rotate by the driving mechanism 660, and the circulation pump 400 is configured to run to drive the sewage in the filter device 600 to be discharged into the sewage pipeline 240. After the sewage discharge operation is completed, the drainage pipeline 210 is connected with the external discharge pipeline 250 by the switching device 270, that is, the circulation pump 400 is connected with the external discharge pipeline 250. The circulation pump 400 is configured to run to drive the water in the water holding barrel 100 to drain out of the washing machine through the external discharge pipeline 250.

In the above solutions, the circulation pump 400 is used for not only driving water in the water holding barrel 100 to be circularly filtered, but also to be drained out of the washing machine. Part of the pipelines is shared in the circulating filtration operation and the sewage drainage operation, which simplifies the arrangement of the waterways in a washing machine and is beneficial to save space in a washing machine.

In a further solution of this embodiment, before water is supplied for washing/rinsing, the circulation pipeline 220 and the drainage pipeline 210 are connected with the filter device 600 and the circulation pump 400 by the switching device, and then water starts to be supplied to the water holding barrel 100. In a case that the water level in the water holding barrel 100 is greater than a preset water level, the circulation pump 400 is turned on and the circulation filtration operation is executed. After the circulation filtration operation is completed, the sewage discharge operation is executed. The circulation filtration operation and the sewage discharge operation are executed alternately until the washing/rinsing process is completed.

In the circulation filtration operation of the embodiment, the preset number of times in step S4 is set to 3 times. That is, in one circulation filtration operation, the circulation pump 400 is turned on for three times by a washing machine and turned off on a third time. After the driving mechanism 660 is turned on to drive the filter mechanism 620 to continuously rotate in the filter chamber 610 for the second preset time $T_2$, the sewage control valve 241 is opened to open the sewage pipeline 240 for executing the sewage operation.

Figure 6:
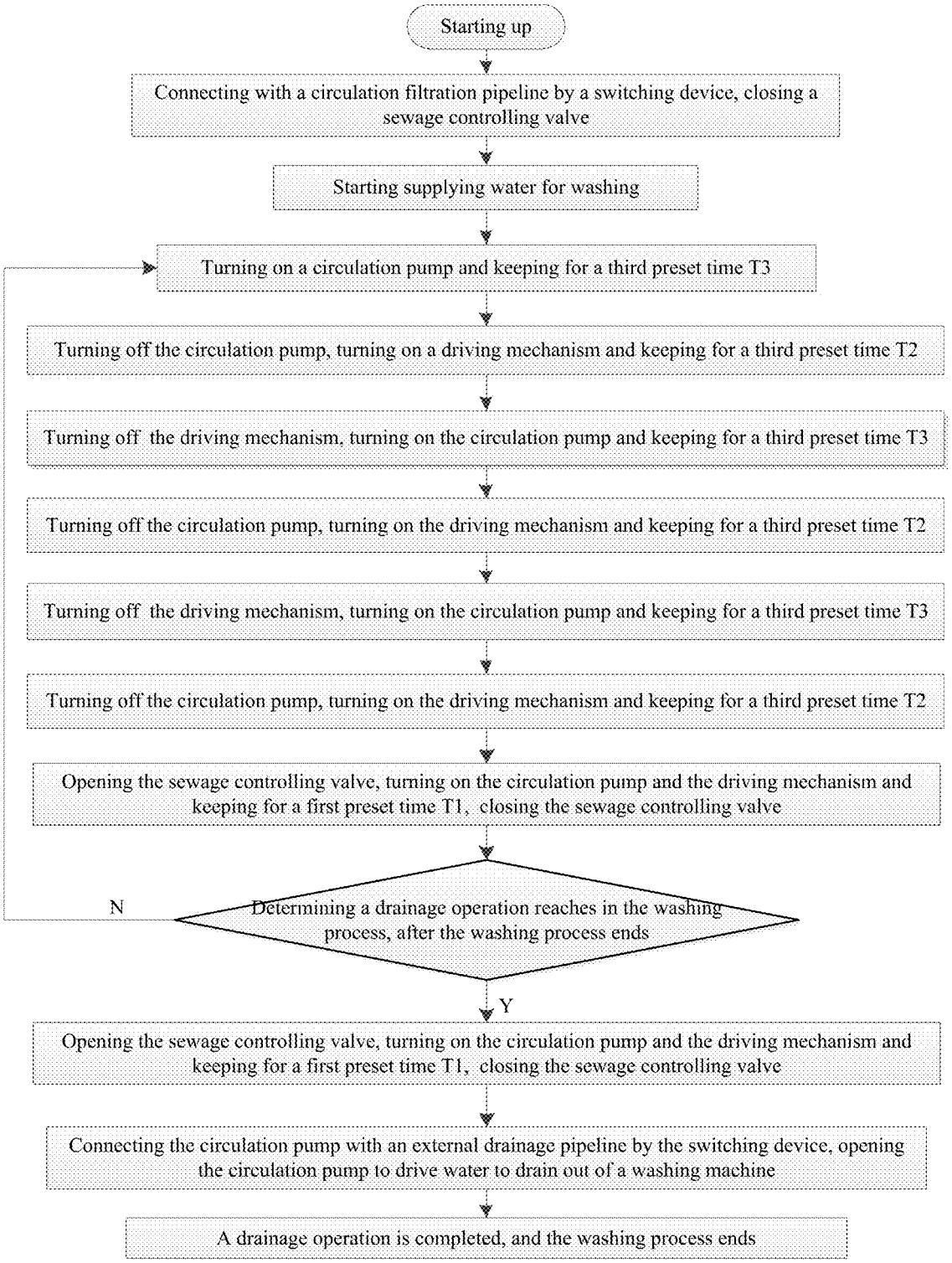
FIG. 6 is a flow chart of a control method of a washing machine in Embodiment 1 of the present application.

As shown in FIG. 6, a flow chart from startup to completion of a washing process of a washing machine in the embodiment, includes the following steps:

1) turning on a washing machine;
2) the circulation filtration pipeline being opened by the switching device, and the sewage control valve being kept to be closed;
3) supplying water;
4) turning on the circulation pump and keeping running for a third preset time $T_3$;
5) turning off the circulation pump, turning on the driving mechanism and keeping running for a second preset time $T_2$;
6) turning off the driving mechanism, turning on the circulation pump and keeping running for the third preset times $T_3$;
7) turning off the circulation pump, turning on the driving mechanism and keeping running for the second preset time $T_2$;
8) turning off the driving mechanism, turning on the circulation pump and keeping running for the third preset times $T_3$;
9) turning off the circulation pump, turning on the driving mechanism and keeping running for the second preset time $T_2$;

10) opening the sewage control valve, turning on the circulation pump and the driving mechanism at the same time for the first preset time $T_1$, and closing the sewage control valve;

11) circularly executing step 4) to step 10) until a washing process is completed and a discharge process is reached;

12) opening the sewage control valve, turning on the circulation pump and the driving mechanism at the same time for the first preset time $T_1$, and closing the sewage control valve;

13) connecting the circulation pump with the external discharge pipeline by the switching device, and draining water out of a washing machine to the outside by the circulation pump;

14) ending the washing program after the discharge process is completed.

The washing machine of the embodiment is controlled to execute a rinsing process after the washing process is completed. The operation of the rinsing process is similar to that of the washing process. The circulation filtration pipeline is opened by the switching device 270, and the sewage control valve 241 is in a closed state. The sewage discharge operation is executed after supplying water for a rinsing process, and then the sewage discharge operation is executed. The circulation filtration operation and the sewage discharge operation are executed alternately until the rinsing process is completed and the drainage in the rinsing process is reached. At this time, the sewage discharge operation is first executed, and then the circulation pump 400 is connected with the external discharge pipeline 250 by the switching device 270. Water in the water holding barrel 100 is drained out of the washing machine by the circulation pump 400.

In the embodiment, the circulation filtration operation and the sewage discharge operation are alternately executed in a washing process and a rinsing process of a washing machine, so the filter impurities is timely drained out of the filter device 600 through the sewage outlet 6103 and avoided being accumulated to affect the filtration efficiency. In the circulation filtration operation, the circulation pump 400 is controlled to be turned on intermittently. In a period when the circulation pump 400 is closed, the filter mechanism 620 is driven to rotate by the driving mechanism 660, so that filter impurities such as lint attached to the filter mechanism 620 is fully peeled off, and then the sewage is fully discharged in executing the sewage discharge operation. Through the above processes, the filter device 600 can be self-cleaned at any time in executing the washing program, thereby avoiding the clogging of the filter device 600 and ensuring the filtration efficiency of water in the washing machine.

When the washing machine is controlled to execute a sewage discharge operation, the circulation pump 400 as a driving force is used for driving to discharge the sewage, and there is no need of additional driving force for draining the sewage out of the filter device 600. So regardless of the arrangement of the sewage pipeline 240, the sewage is fully drained out of the filter device 600 to avoid remaining the sewage carrying the filtered impurities. Due to omitting an additional driving force, it is avoided that an additional driving device occupying space in the washing machine, and also saves costs by reducing the use of driving device.

Embodiment 2

As shown in FIGS. 1 to 5, the embodiment is further described based on Embodiment 1. A height of the water inlet 6101 of the filter device 600 is higher than a highest water level of a washing machine. A last rinsing process of the washing machine is executed as the following steps:

turning on the circulation pump 400, the circulation filtration pipeline being opened, and executing the circulation filtration operation in a rinsing process of the washing machine;

turning off the circulation pump 400 after the rinsing process is completed;

turning on a driving mechanism 660 to drive the filter mechanism 620 to rotate in the filter chamber 610;

when a first setting condition is met, turning on the circulation pump 400, and opening the sewage control valve 241 to open the sewage pipeline 240; and When a second setting condition is met, cutting off the circulation filtration pipeline.

Preferably, after the first setting condition is met, the driving mechanism 660 is kept running and drives the filtering mechanism 620 to continuously rotate.

In the embodiment, a process of connecting the circulation filtration pipeline includes: connecting with an outlet end of the circulation pump 400 by the switching device 270, and opening the return water control valve 231 to connect the return water pipeline 230. A process of cutting off the circulation filtration pipeline includes: connecting the external discharge pipeline 250 with the outlet end of the circulation pump 400 by the switching device 270.

It can be understood that the above process of cutting off the circulation filtration pipeline can also be achieved by shutting down the circulation pump 400.

In the above solutions, the rinsing water in a washing machine is circularly filtered during the rinsing process, and the filter device 600 and the circulation filtration pipeline are always filled with rinsing water. After the rinsing process is completed and the circulation pump 400 is turned off, the water in the drainage pipeline 210 and the circulation pipeline 220 flows back downwards under the action of gravity, and can flow back up to the level of the water surface in the drainage pipeline 210 being flush with the water level in the water holding barrel 100, and the pipeline between the above water surface and the filter device 600 is filled with air. However, the filter device 600 is lower than the circulation pipe 220, and the water therein does not flow back through the circulation pipe 220. When the circulation pump 400 is turned off and the return water control valve 231 is also closed, and the sewage control valve 241 is in a closed state at this time, water inside the filter device 600 remains in the filter chamber 610 and does not be discharged outward.

The driving mechanism 660 is turned on to drive the filter mechanism 620 to rotate at a high speed, so that the filtered impurities such as lint attached to the surface of the filter mechanism 620 is peeled off under the action of centrifugal force. At this time, since both the return water control valve 231 and the sewage control valve 241 are closed, water in the filter chamber 610 does not flow out. The filter mechanism 620 is configured to rotate at a high speed to stir water in the filter chamber 610, forming a turbulent water flow to take an impact force on the surface of the filter mechanism 620, so that the lint is peeled off. The lint peeled off from the surface of the filter mechanism 620 is mixed into water in the filter chamber 610.

When the circulation pump 400 is turned on and the sewage control valve 241 is also opened, the sewage pipeline 240 is connected, and the sewage in the filter device 600 can be discharged from the sewage outlet 6103. The circulation pump 400 is turned on, to drive the air in the drainage pipeline 210 and the circulation pipeline 220 to flow into the filter device 600, so that the sewage carrying lint in the filter device 600 is completely discharged from the sewage outlet 6103 under the air pressure. The sewage is prevented from remaining in the filter device 600, so a good cleaning effect on the filter device 600 is achieved. The sewage control valve 241 is opened and the circulation pump 400 is turned on, so air flows into the filter device 600 to generate the air pressure, thereby ensuring that the sewage in the filter device 600 is fully discharged.

In order to prevent water in the water holding barrel 100 from flowing into the filter device 600 through the circulation pipe 220 after the sewage in the filter device 600 is drained, the washing machine is preset with a second setting condition. When the second setting condition is met, the circulation pipeline is cut off, and water in the water holding barrel 100 is prevented from flowing into the filter device 600.

In the embodiment, during the washing process and the intermediate rinsing process of a washing machine, water in the water holding barrel 100 flows into the filter device 600 by the action of the circulation pump 400, thereby driving the sewage in the filter device 600 to be discharged. However, in the last rinsing process, the washing machine does not execute a circulation filtration in next steps. If water is remained in the filter device 600 after the washing machine stops running, the inside of the filter device 600 is in a humid environment and not easy to dry. So the circulation pump 400 is first turned off and air flows in the pipeline, and then the circulation pump 400 is again turned on to drive the air in the pipeline to flow into the filter device 600, so that the sewage in the filter device can be completely drained, effectively avoiding the growth of bacteria caused by the humid environment.

In a specific solution of the embodiment, the first setting condition may be defined that the circulation pump 400 is turned off for the first set time t1, and the second setting condition may be defined that the circulation pump 400 is turned on for the second set time t2.

In the above solutions, the specific values of the first set time t1 and the second set time t2 can be obtained in advance through a large number of experiments and directly written into the control program of a washing machine.

Specifically, the value of the first set time t1 is approximately a maximum time for which it takes that the water level in the drainage pipe 210 decreases from starting to stopping, and the value of the second set time t2 is approximately a minimum time for which it takes that the water level in the drainage pipe 210 rises to near the top of the drainage pipe 210 after the circulation pump 400 is turned on. In this way, it can be ensured that a larger amount of air can flow into the pipeline when the circulation pump 400 is turned off, and at the same time, it can effectively prevent water from entering the filter device 600 after the circulation pump 400 is turned on.

In another solution of the embodiment, a height of the water level can also be used as the first setting condition and the second setting condition. Specifically, the first setting condition is defined that the water level in the pipeline between the circulation pump 400 and the filter device 600 reaches a first set value H1. The second setting condition is defined that the water level in the pipeline between the circulation pump 400 and the filter device 600 reaches a second set value H2. Among them, $H1<H2$.

In the embodiment, the above water level is specifically defined as a height of the water level in the drainage pipeline 210. A water level detection device may be provided in the drainage pipeline 210 of a washing machine to detect the water level in the drainage pipeline 210.

In the above solutions, the value of the first set value H1 is greater than and as close as possible to a highest water level of a washing machine, to ensure that after the circulation pump 400 is turned off, the water level in the drainage pipeline 210 can descend to the first set value H1.

There is generally a certain time difference between receiving a signal that the water level in the drainage pipeline 210 rises to the second set value H2 and connecting the drainage pipeline 210 with the external drainage pipeline 250 by switching the switching device 270. A difference $\Delta H$ is required between the value of the second set value H2 and a distance between the water level and the top of the drainage pipeline 210, so that it is avoided that water flows into the filter device 600 due to response delay after the circulation pump 400 is turned on. The specific value of the difference $\Delta H$ can be in advance obtained through a large number of experiments, to ensure that the washing machine has sufficient response time to control the switching device 270 to complete the switching of the waterways after receiving the signal that the water level reaches the second set value H2.

The control method for a washing machine in the embodiment can fully drain water out of the filter device 600 before draining water in the last rinsing process, so that there is no rinse water remaining in the filter device 600 after a washing machine finishes the washing programs. In this way, when a washing machine is turned off, the internal environment of the filter device 600 can be close to dry to the greatest extent, thereby reducing the problem of bacterial growth.

Embodiment 3

As shown in FIGS. 1 to 5, the embodiment is further described based on the above embodiments. A washing machine further includes a recovery device 500 connected to the sewage pipeline 240.

Specifically, an outlet end of the sewage pipeline 240 is connected with the recovery device 500. During a sewage discharge process of a washing machine, the circulation pump 400 runs to drive the sewage carrying the filtered impurities in the filter device 600 to be discharged into the recovery device 500 through the sewage pipeline 240.

The filtered impurities are mainly composed of fibers falling off from clothes in washing clothes. With the popularity of chemical fiber fabrics, the fibers falling off from clothes contain a large amount of microplastics. When entering the natural water environment, the microplastics seriously harm the ecological environment and human health.

In the above solutions, after being discharged from the sewage outlet 6103, the sewage carrying the filtered impurities in the filter device 600 can enter and be collected in the recovery device 500, without being merged into the water and directly discharged out of the washing machine. Through the above method, it is avoided that the microplastics in the filtered impurities are discharged with the water flow and enter the ecological cycle to harm the ecological environment and human health.

The recycling device 500 in the embodiment specifically includes:

- a housing 510 having a recovery chamber inside; and
- a filter component 520, disposed in the recovery chamber and dividing the recovery chamber into a first chamber 531 and a second chamber 532.

The sewage pipeline 240 is connected with the first chamber 531. The sewage carrying the filtered impurities flows in the first chamber 531, and then flows in the second chamber 532 after being filtered by the filter component 520. The filtered impurities are collected in the first chamber 531.

In the above solutions, the filter component 520 is provided in the recovery device 500 to filter the sewage discharged from the filter device 600 and separate the filtered impurities therein from water. The interior of the recovery device 500 is divided into the first chamber 531 and the second chamber 532 through the filter component 520. The filtered impurities in the sewage are blocked by the filter component 520, thereby collecting the filtered impurities on an upper surface of the filter component 520 in the first chamber 531. The clean water obtained after filtration is collected in the second chamber 532. Users can directly collect and treat the separated filter impurities, so it is avoided that the filtered impurities is mixed in water and cannot be effectively treated.

Specifically, the filter component 520 includes a frame horizontally arranged at a certain height in the recovery chamber and a filter screen arranged on the frame. After the sewage carrying the filtered impurities flows in the first chamber 531, the water can flows in the second chamber 532 through the filter component 520. The filtered impurities are blocked by the filter screen and remain on the upper surface of the filter component 520.

The housing 510 of the recovery device 500 is disposed in a case 10 in a manner of being capable of being insertable and extractable, and an upper of the housing 510 has an opening. When the housing 510 is pulled out of the case 10, the filter impurities attached to the upper surface of the filter component 520 can be cleaned through the opening on the upper of the housing 510. The filter component 520 is preferably detachably connected with the housing 510. User can detach the filter component 520 from the interior of the housing 510 and take it out for cleaning, so it is more convenient to operate.

In a preferred solution of the embodiment, a water outlet is provided on the second chamber 532 for discharging the clean water. By arranging the water outlet in the second chamber 532, the clean water flowing in the second chamber 532 can be discharged from the recovery device 500 timely, thus preventing the recovery device 500 from overflowing when a large amount of sewage is discharged from the filter device 600. Otherwise, a capacity of the second chamber 532 needs to be increased, that is, the volume of the recovery device 500 needs to be increased, so the recovery device can occupy a larger space inside the washing machine, which is not conducive to miniaturization of the overall volume of the washing machine.

On the other hand, water in the second chamber 532 can be automatically discharged from the water outlet. When the recovery device 500 is cleaned, only the filtered impurities on the filter component 520 need to be removed, without manually pouring out the clean water in the second chamber 532. Because the filter component 520 is detachably installed in the housing 510, user does not need to completely take the housing 510 out of the washing machine box 10, only needs to take out the filter component 520 for cleaning, which is more convenient to operate.

In a preferred solution of this embodiment, the water outlet of the second chamber 532 is connected with the water holding barrel 100, and water collected in the second chamber 532 is delivered to the water holding barrel 100. For example, the water outlet of the second chamber 532 can be connected with the return water pipeline 230, or directly connected with the water holding barrel 100 through the pipeline.

Since the sewage flowing in the recovery device 500 is filtered by the filter component 520 in the recovery device 500, the filtered impurities are removed, and the clean water in the second chamber 532 does not contain the filtered impurities. By delivering the clean water into the water holding barrel 100, the clean water can be reused, thereby reducing the amount of water when the washing machine continues to run. So the water consumption of the washing machine is saved.

In another preferred solution of the embodiment, the water outlet of the second chamber 532 may be directly or indirectly connected with the outside of the washing machine. For example, the water outlet of the second chamber 532 is connected with the external drainage pipeline 250 through a pipeline, and water in the second chamber 532 is discharged from the washing machine through the external drainage pipeline 250.

The clean water in the second chamber 532 does not contain the filtered impurities, and is discharged directly to the ecological environment without the problem caused by microplastics.

In the embodiment, by arranging a recovery device 500 inside the washing machine to receive the sewage discharged from the filter device 600, the filtered impurities carried in the sewage can be collected, so there is no the filtered impurities with microplastics to be directly mixed into the water flow and entering the ecological environment.

Embodiment 4

As shown in FIGS. 1 to 5, the embodiment is further described based on the above embodiments. Cleaning particles 680 are also configured in the filter chamber 610 for filter device 600, for cleaning an inner wall of the filter chamber 610 and an outer wall of the filter mechanism 620 by friction and collision along the water flow.

In the embodiment, during the circulation filtration process, the cleaning particles 680 continuously rub against the inner wall of the filter chamber 610 and the outer wall of the filter mechanism 620 with the flowing water, and the filtered impurities attached on the walls fall off, thereby preventing the filtered impurities from being deposited too quickly to cover the filter mechanism 620, affecting the filtration efficiency. On the other hand, it is avoided that the filtered impurities is firmly attached on the inner wall of the filter chamber 610 or the outer wall of the filter mechanism 620 and too thick, and that the filtered impurities is not easily peeled off when the driving mechanism 660 drives the filter mechanism 620 to rotate.

In the embodiment, a shape of the cleaning particles 680 can be in spherical, ellipsoidal, elliptical cylindrical, etc. The cleaning particles 680 may have a smooth surface or a non-smooth surface. It is preferred that the cleaning particles 680 have a non-smooth surface, which can increase the friction between the cleaning particles 680 and the inner wall of the filter chamber 610 and the outer wall of the filter mechanism 620, to achieve a better effect of peeling off filtered impurities.

The cleaning particles 680 are preferably made by a wear-resistant elastic material to prevent the cleaning particles 680 from being easily worn during use. A resilience of the cleaning particles 680 is preferably in a range of 0% to 50%. The cleaning particles 680 made of elastic materials that are easily deformed under force are prevented from blocking the rotation of the filter mechanism 620 and even causing the filter device 600 to be damaged.

In a further solution of the embodiment, a blocking mechanism is also provided in the filter chamber 610. The blocking mechanism divides the interior of the filter chamber 610 into a first space and a second space. The water inlet 6101 is connected with the first space, and the filtered water outlet 6102 and the sewage outlet 6103 are connected with the second space, and the cleaning particles 680 are provided in the first space.

In the above solutions, the blocking mechanism divides the interior of the filter chamber 610 into the first space on the left and the second space on the right, and the main body of the filter mechanism 620 is located in the first space. During the filtration process, the cleaning particles 680 are between the filter chamber 610 and the filter mechanism 620 in the first space, and continuously rub against the inner wall of the filter chamber 610 and the outer wall of the filter mechanism 620 along the water flow to causing the attached filtered impurities to fall off. When the filter mechanism 620 rotates in the filter chamber 610, the cleaning particles 680 move in the filter chamber 610 with the action of the turbulent water flow, and rub against the inner wall of the filter chamber 610 and the outer wall of the filter mechanism 620, which can improve in peeling off the filtered impurities. When the sewage is discharged outward, the water flow can be discharged from the sewage outlet 6103 through the blocking mechanism, and the cleaning particles 680 are blocked by the blocking mechanism and remained in the first space on the left side. So the cleaning particles 680 are prevented from being discharged with the water flow through the sewage outlet 6103, or blocking the sewage outlet to affect the efficiency of draining the sewage.

The blocking mechanism includes a baffle 690 disposed inside the filter chamber 610, and the first space and the second space are respectively formed on the left and right sides of the baffle 690. The water inlet 6101 and the cleaning particles 680 are located on the left side of the baffle 690, and the filtered water outlet 6102 and the sewage outlet 6103 are located on the right side of the baffle 690. A plurality of water holes 691 are formed on the baffle 690. The first space is communicated with the second space through the water holes 691, but the cleaning particles 680 are restricted in the first space by the baffle 690 and cannot enter the second space.

Further, an outer periphery of the baffle 690 is in contact with or in nearly contact with the inner wall of the filter chamber 610, a width of the water holes 691 is $D_1$, the width of the cleaning particles 680 is d, and $D_1<d$.

The water holes 691 in the embodiment are in a circular shape, and the width $D_1$ of the water holes 691 is a diameter of the water holes 691. It can be understood that the water holes 691 can also be configured as other shapes, such as square holes, strip holes, etc., in which the minimum size of the water holes 691 in different directions is the width $D_1$.

Similarly, for the cleaning particles 680 in a spherical shape, the width d of the cleaning particles 680 is a diameter of the cleaning particles 680. For the cleaning particles 680 of other shapes, of which the sizes in different directions are not exactly the same, the smallest size among the different directions is the width d. So the cleaning particles 680 cannot pass through the water holes 691 on the baffle 690 no matter how they turn over, thereby ensuring that the baffle 690 effectively blocks the cleaning particles 680.

In a further solution of this embodiment, a density of the cleaning particles 680 is smaller than that of water. After the water flows in the filter chamber 610, the cleaning particles 680 can float in water, and be easier driven to move in the first space of the filter chamber 610 by the water flow to generate friction and collision, to accelerate the uniform dissolution of the clothing treatment agent or cause the filtered impurities to fall off. It is avoided the situation that the cleaning particles 680 are deposited at the bottom of the filter chamber 610 and cannot play an effective role when the impact force of the water flow is insufficient.

In a further solution of the embodiment, the filter mechanism 620 includes a water outlet joint 621 extending toward the filtered water outlet 6102 along a rotation axis. One end of the water outlet joint 621 is connected to the main body of the filter mechanism 620 and is located on the left side of the baffle 690, and another end passes through the baffle 690 and is rotatably inserted into the filtered water outlet 6102. The baffle 690 is provided with a through hole for the water outlet joint 621 to pass through, and the through hole fits with an outer wall of the water outlet joint 621 with a clearance.

In the above solutions, the filtered water inside the filter mechanism 620 flows out through the water outlet joint 621. The outer wall of the water outlet joint 621 is not in contact with the inner wall of the through hole on the baffle 690, so the baffle 690 and the water outlet joint 621 are prevented from being interacted to generate the friction and resistance when the filter mechanism 620 rotates, which affects the smooth rotation of the filter mechanism 620.

In the embodiment, the cleaning particles 680 are configured in the filter chamber 610. The cleaning particles 680 can rub against the inside of the filter chamber 610 and the outer wall of the filter mechanism 620 to prevent excessive deposition of the filtered impurities and improve in peeling off of filter impurities when the filter mechanism 620 rotates. Further the self-cleaning effect of the filter device 600 is improved.

Embodiment 5

Figure 7:
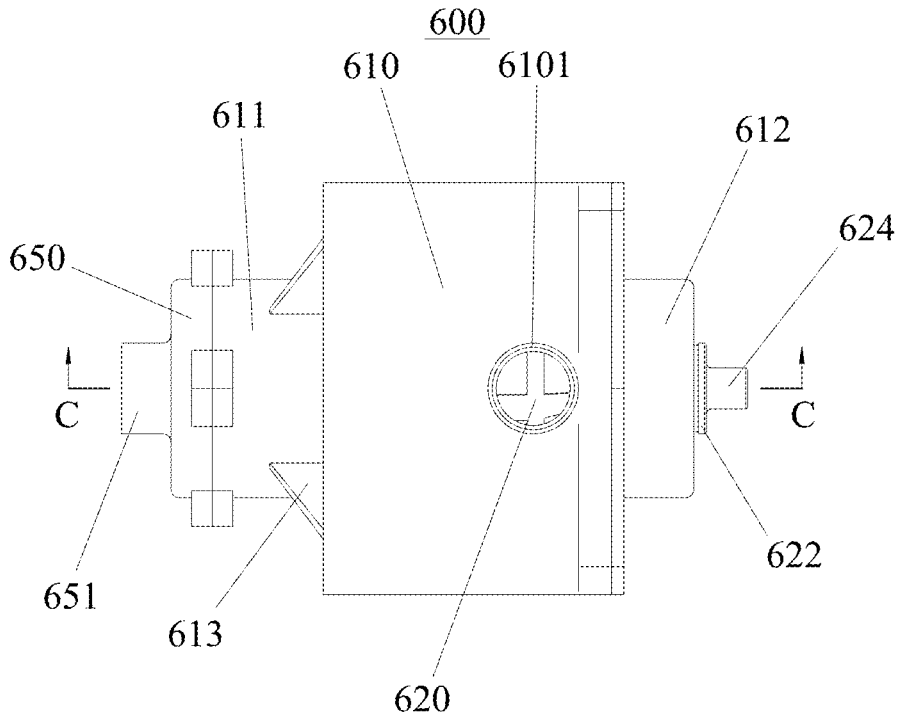
FIG. 7 is a structural diagram of a filter device in Embodiment 5 of the present application.
Figure 8:
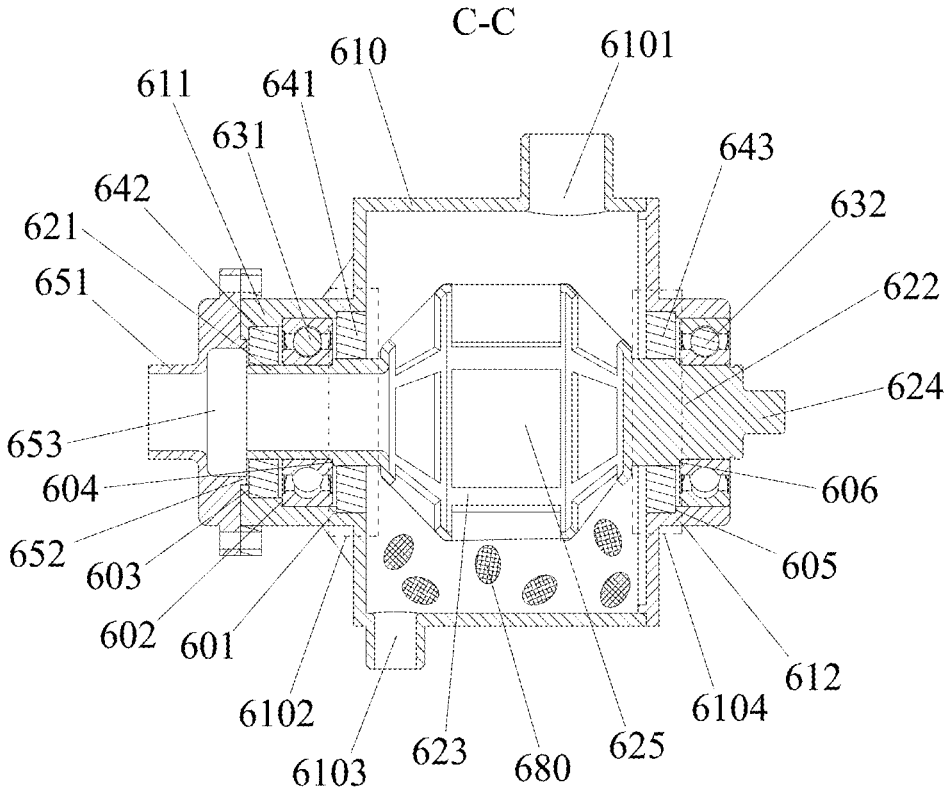
FIG. 8 is a schematic diagram of a C-C section in FIG. 7 of the present application.

As shown in FIGS. 7 and 8, the embodiment is further described for the filter device 600 (the baffle is not shown in the figure) in the above embodiments. An outer periphery of the filtered water outlet 6102 is configured to extend toward the outside of the filter chamber 610 to form a sealing support part 611. The water outlet joint 621 of the filter mechanism 620 is inserted into the sealing support part 611, and is rotatably and hermetically connected with the sealing support part 611. A first bearing 631 is arranged on the water outlet joint 621. A first sealing member 641 is arranged on a side of the first bearing 631 facing the interior of the filter chamber 610. The first sealing member 641 is used for blocking a gap between the water outlet joint 621 and the seal support part 611.

In the above solutions, the first bearing 631 is arranged between the water outlet joint 621 and the sealing support part 611 to support the water outlet joint 621. The water outlet joint 621 rotates more smoothly in the sealing support part 611, and the structure is stable, so the filter mechanism 620 can stably rotates in the filter chamber 610. The first sealing member 641 is arranged on the right side of the first bearing 631, so that water in the filter chamber 610 cannot flow in the gap between the water outlet joint 621 and the sealing support part 611, thus preventing the first bearing 631 from contacting water and avoiding the failure of the first bearing 631. Therefore, the effect of the first bearing 631 is ensured. By arranging the first sealing member 641, unfiltered washing water from flowing out from the filtered water outlet 6102 is prevented from flowing out through the sealing support part 611, and the removal efficiency of the filtered impurities by the filter device 600 are not affected.

In the specific solution of the embodiment, the first sealing member 641 is sleeved on the water outlet joint 621, an inner wall of the first sealing member 641 is hermetically connected with an outer wall of the water outlet joint 621, and an outer wall of the first sealing member 641 is hermetically and rotatably connected with an inner wall of the sealing support part 611.

In a further solution of the embodiment, the filter device 600 also includes a second sealing member 642. The second sealing member 642 is arranged on a side of the first bearing member 631 facing away from the inside of the filter chamber 610, for blocking a gap between the water outlet joint 621 and the sealing support part 611.

Specifically, the second sealing member 642 is sleeved on the water outlet joint 621, an inner wall of the second sealing member 642 is hermetically connected with the outer wall of the water outlet joint 621, and an outer wall of the second sealing member 642 is hermetically and rotatably connected with the inner wall of the sealing support part 611.

In the above solutions, the second sealing member 642 is also arranged on the left side of the first bearing 631. Water flowing out through the water outlet joint 621 can be blocked by the second sealing member 642 and is not in contact with the first bearing 631. The first bearing 631 is located between the first sealing member 641 and the second sealing member 642, so that the installation environment of the first bearing 631 is in a water-free state to the greatest extent. The first bearing 631 is prevented from rusting in water, and the filter mechanism 620 can smoothly rotate.

In a further solution of the embodiment, the inner wall of the sealing support part 611 has a stepped structure. Annular structures are sequentially formed from an end of the sealing support part 611 to the outside of the filter chamber 610. Inner diameters of the annular structures are gradually decreased from a first limiting surface 601, a second limiting surface 602 and a third limiting surface 603.

A surface of the first sealing member 641 facing the outside of the filter chamber 610 abuts against the first limiting surface 601. A surface of the first bearing 631 facing outside the filtering chamber 610 abuts against the second limiting surface 602. A surface of the second sealing member 642 facing the outside of the filter chamber 610 abuts against the third limiting surface 603.

In the above solutions, a plurality of vertical annular limiting surfaces are formed on the inner wall of the sealing support part 611 with a stepped structure, which respectively abut against the left surfaces of the first sealing member 641, the first bearing 631 and the second sealing member 642 to restrict the movement of the above three parts in the axial direction of the water outlet joint 621. So the match between the water outlet joint 621 and the sealing support part 611 is prevented from loosening during the rotation of the filter mechanism 620.

In a preferred solution of the embodiment, the outer diameter of the end of the water outlet joint 621 near the outside of the filter chamber 610 is smaller than the outer diameter of the other end. Annular structures are formed on the outer wall of the water outlet joint 621, and a fourth limiting surface 604 of the water outlet joint 621 is perpendicular to the axis of the water outlet joint 621. A surface of the first bearing 631 facing the interior of the filter chamber 610 abuts against the fourth limiting surface 604.

The outer diameter of the left end of the water outlet joint 621 is smaller than that of the right end, and the fourth limit surface 604 towards the left is formed at the abrupt change in the outer diameter and abuts against the right side surface of the first bearing 631. In this way, both sides of the first bearing 631 are limited by the limiting structures, and the structure is more stable.

In the embodiment, the end of the sealing support part 611 away from the filter chamber 610, that is, the left end of the sealing support part 611 is connected with the filter chamber flange 650. The middle of the filter chamber flange 650 has a through-opening 653 for being communicated with the water outlet joint 621. An outer periphery of the through-opening 653 is extended away from the sealing support part 611 to form a connection part 651.

Preferably, the surface of the filter chamber flange 650 facing the side of the sealing support part 611 has a protruding insertion part 652, and the insertion part 652 is inserted into the opening at the left end of the sealing support part 611.

In the above solutions, the left end of the sealing support part 611 is connected with the filter chamber flange 650, and the connection part 651 is formed on the filter chamber flange 650. An outer diameter of the connection part 651 is smaller than the outer diameter of the sealing supporting part 611, and an inner diameter of the connection part 651 is preferably equal to the inner diameter of the water outlet joint 621. When the filter device 600 is installed in the washing machine, the connection part 651 is connected with the return water pipeline. Compared with the way that the return water pipeline is directly connected to the left end of the sealing support part 611, the installation is easier.

The right side of the filter chamber flange 650 has the insertion part 652 inserted into the opening of the left end of the sealing support part 611, which facilitates the positioning of the filter chamber flange 650 and the sealing support part 611 during assembly. A number of fixing parts are respectively arranged on the periphery of the filter chamber flange 650 and the sealing support part 611, and the filter chamber flange 650 is fixed with the sealing support part 611 by screws passing through the fixing parts.

In a further solution of the embodiment, the outer wall of the sealing support part 611 is provided with a reinforcing rib 613 extending in a radial direction of the sealing support part 611, and the reinforcing rib 613 is connected with a surface of the filter chamber 610 where the filtered water outlet 6102 is located.

The sealing support part 611 extends through the left end of the filter chamber 610 by a length. The reinforcing rib 613 are used for supporting the peripheral side wall of the sealing support part from the outside, ensuring the strength of the sealing support part 611.

In the embodiment, the filter mechanism 620 includes a frame and a filter screen 625. The frame includes:

- a filter support part 623 located inside the filter chamber 610, wherein the filter screen 625 covers a surface of the filter support part 623, and the filter support part 623 and the filter screen 625 together constitute a main part of the filter mechanism 620;
- a water outlet joint 621, provided on a left of the filter support part 623, and rotatably inserted into the sealing support part 611; and
- a rotation support part 622, provided on a right of the filter support part 623 and rotatably connected with the filter chamber 610.

In a further solution of the embodiment, the rotation support part 622 on the right of the filter mechanism 620 is configured to extend toward the outside of the filter chamber 610 along the rotation axis. The filter chamber 610 is provided with an installation port 6104 for allowing the rotation support part 622 to pass through. The rotation support part 622 is rotatably and hermetically connected with the installation port 6104.

The rotation support part 622 is used to connect with the driving mechanism for driving the filter mechanism 620 to rotate. The rotation support part 622 is configured to extend out from the right of the filter chamber 610, and a motor installation part 624 is provided on a right of the rotation support part 622 for connecting with the driving mechanism. Therefore, the driving mechanism can be arranged outside the filter chamber 610 to avoid being in contact with water.

Further, the outer periphery of the installation port 6104 is configured to extend toward the outside of the filter chamber 610 along the axis of the rotation support part 622 to form a sleeve part 612, and a third sealing member 643 is sleeved on the rotation support part 622. An inner wall of the third sealing member 643 is hermetically connected with an outer wall of the rotation support part 622, and an outer wall of the third sealing member 643 is rotatably and hermetically connected with an inner wall of the sleeve part 612.

A second bearing 632 is also provided between the sleeve part 612 and the rotation support part 622. The second bearing 632 is sleeved on the rotation support part 622 and is located on a side of the third sealing member 643 facing the outside of the filter chamber 610.

In the above solutions, through the arrangement of the third sealing member 643, water in the filter chamber 610 is prevented from leaking out from the installation port 6104. The second bearing 632 is used for supporting the rotation support part 622 to ensure that the rotation support part 622 smoothly rotates in the sleeve part 612. The second bearing 632 is arranged on the right side of the third sealing member 643 and is not in contact with the water in the filter chamber 610 to avoid failure.

In a preferred solution of the embodiment, an inner diameter of one end of the sleeve part 612 close to the outside of the filter chamber 610 is smaller than an inner diameter of the other end. A fifth limiting surface 605 with an annular structure is formed on the inner wall of the sleeve part 612, and is perpendicular to the axis of the rotation support part 622. The surface of the third sealing member 643 facing the outside of the filter chamber 610 is in contact with the fifth limiting surface 605.

An outer diameter of one end of the rotation support part 622 close to the outside of the filter chamber 610 is smaller than an outer diameter of the other end. A sixth limiting surface 606 with an annular structure is formed on the outer wall of the rotation support part 622, and is perpendicular to the axis of the rotation support part 622. The surface of the second bearing 632 facing the interior of the filter chamber 610 is in contact with the sixth limiting surface 606.

In the above solutions, the inner diameter of the right end of the sleeve part 612 is smaller than the inner diameter of the left end. The fifth limiting surface 605 toward the left is formed at a sudden change in the inner diameter, and in contact with the right surface of the third sealing member 643. The outer diameter of the right of the rotation support part 622 is smaller than the outer diameter of the left. The sixth limiting surface 606 toward the right is formed at a sudden change in the outer diameter, and is in contact with the left surface of the second bearing 632. The above structure limits the movement of the third sealing member 643 and the second bearing 632 in the axial direction of the rotation support part 622, and is stable.

Furthermore, the cross-sectional area of the middle region of the filter support part 623 is constant, and a tapered structure is formed on the left and the right of the middle region, so that the partial surface of the filter screen 625 is tilted. It is beneficial to peeling off the filtered impurities attached on the surface.

In the embodiment, the first bearing 631 and the second bearing 632 are respectively provided at both ends of the filter mechanism 620 for supporting, so the filter mechanism 620 can smoothly and stably rotate in the filter chamber 610. Through the arrangement of the first sealing member 641, the second sealing member 642 and the third sealing member 643, the installation spaces of the first bearing 631 and the second bearing 632 are in water-free to the greatest extent, and the first bearing 631 and the second bearing 632 are prevented from being in contact with water to avoid failure of both.

The embodiments merely describe preferred embodiments of the present application, rather than limiting the concept and scope of the present application. The preferred embodiments are disclosed above, and not used for limiting the present application. Under the premise of not departing from the idea of the present application, various changes and improvements made to the technical solution of the present application by those skilled in the art, such as simple amendment, equal change and modify according concept of the present application, shall all fall within the protection scope of the present application. The solutions in the above embodiments can be further combined or substituted.

What is claimed is:

1. A controlling method for a washing machine, including, alternately executing a circulation filtration operation and a sewage discharge operation in a washing process and/or a rinsing process, wherein, the washing machine includes:

a water holding barrel, a circulation filtration pipeline, of which a water inlet and a water outlet are connected with the water holding barrel respectively, and in which a circulation pump is arranged, a filter device, arranged between the circulation pump and the water outlet of the circulation filtration pipeline, and having a sewage outlet for draining sewage outwards, and a sewage pipeline, connected with the sewage outlet of the filter device;

wherein, the circulation filtration operation includes: closing the sewage outlet of the filter device and/or cutting off the sewage pipeline, and running the circulation pump to circulate and filter water in the water holding barrel;

the sewage discharge operation includes: opening the sewage outlet of the filter device and/or connecting the sewage pipeline, and running the circulation pump to drive sewage in the filter device to drain into the sewage pipeline;

wherein the filter device includes:

a filter chamber, on which a water inlet, a filtered water outlet and the sewage outlet are arranged, a filter mechanism, rotatably arranged in the filter chamber, and a driving mechanism, for driving the filter mechanism to rotate in the filter chamber;

wherein the method further includes, in running the circulation pump during the sewage discharge operation, turning on the driving mechanism to drive the filter mechanism to rotate in the filtering chamber.

2. The controlling method for a washing machine according to claim 1, wherein, during the sewage discharge operation, the circulation pump is configured to continue to run for a time, and then the circulation filtration operation is executed.

3. The controlling method for a washing machine according to claim 1, wherein, the circulation filtration operation includes:

S1. closing the sewage outlet of the filter device and/or cutting off the sewage pipeline;

S2. turning on the circulation pump and continuing running for a time;

S3. turning off the circulation pump and stopping running for a time;

S4. if the number of times for executing step S2 reaches a preset number of times in the circulation filtration operation, finishing the circulation filtration operation; if not, returning to step S2.

4. The controlling method for a washing machine according to claim 3, wherein, in Step S3, in a closing state of the circulation pump, the driving mechanism is turned on to drive the filter mechanism to rotate in the filter chamber.

5. The controlling method for a washing machine according to claim 4, wherein, during the sewage discharge operation, the driving mechanism is turned on in an operation of the circulation pump to drive the filter mechanism to continue rotating in the filtering chamber for the first preset time $T_1$, in step S3, the driving mechanism is configured to drive the filter mechanism to continuously rotate in the filter chamber for a second preset time $T_2$, and the second preset time $T_2$ is shorter than the first preset time $T_1$.

6. The controlling method for a washing machine according to claim 1, wherein, the washing machine further includes an external drainage pipeline for draining water to the outside, an inlet end of the external drainage pipeline is connected to the circulation filtration pipeline between the circulation pump and the filter device, and one of the filter device and the external drainage pipeline is connected with the circulation pump, during the washing process and/or the rinsing process, the filter device is connected with the circulation pump, after the washing process and/or the rinsing process is completed, the washing machine is configured to execute the sewage discharge operation, after the sewage discharge operation is completed, the circulation pump is connected with the external drainage pipeline, and the circulation pump is configured to run to drive water in the water holding barrel to be drained out of the washing machine through the external drainage pipeline.

7. The controlling method for a washing machine according to claim 6, wherein, before water is supplied for the washing process and/or the rinsing process, the circulation pump and filter device are connected, water is fed into the water holding barrel, and the circulation filtration operation is executed, after the circulation filtration operation is completed, the sewage discharge operation is executed, and the circulation filtration operation and the sewage discharge operation are executed alternately, until the washing process and/or the rinsing process is completed.

8. The controlling method for a washing machine according to claim 1, wherein, the washing machine includes a recovery device connected with the sewage pipeline, wherein, during the sewage discharge operation, the circulation pump is configured to run to drive the sewage in the filter device to be drained into the recovery device through the sewage pipeline.

9. The controlling method for a washing machine according to claim 3, wherein, in step S2, the circulation pump is configured to continue running for a third preset time $T_3$, in step S3, the circulation pump is turned off and kept being closed for a second preset time $T_2$, and the third preset time $T_3$ is greater than the second preset time $T_2$.

10. The controlling method for a washing machine according to claim 3, wherein, executing the circulation filtration operation in the rinsing process of the washing machine;

turning off the circulation pump after the rinsing process is completed;

turning on the driving mechanism to drive the filter mechanism to rotate in the filter chamber;

when a first setting condition is met, turning on the circulation pump, and opening the sewage control valve to open the sewage pipeline; and when a second setting condition is met, cutting off the circulation filtration pipeline.

11. The controlling method for a washing machine according to claim 10, wherein, after the first setting condition is met, the driving mechanism is kept running and drives the filtering mechanism to continuously rotate.

12. The controlling method for a washing machine according to claim 10, wherein, the first setting condition is configured that the circulation pump is turned off for a first set time t1, and the second setting condition is configured that the circulation pump is turned on for the second set time.

13. A controlling method for a washing machine, including, alternately executing a circulation filtration operation and a sewage discharge operation in a washing process and/or a rinsing process, wherein the washing machine includes:

a water holding barrel, a circulation filtration pipeline, of which a water inlet and a water outlet are connected with the water holding barrel respectively, and in which a circulation pump is arranged, a filter device, arranged between the circulation pump and the water outlet of the circulation filtration pipeline, and having a sewage outlet for draining sewage outwards, and a sewage pipeline, connected with the sewage outlet of the filter device;

wherein, the circulation filtration operation includes: closing the sewage outlet of the filter device and/or cutting off the sewage pipeline, and running the circulation pump to circulate and filter water in the water holding barrel;

the sewage discharge operation includes: opening the sewage outlet of the filter device and/or connecting the sewage pipeline, and running the circulation pump to drive sewage in the filter device to drain into the sewage pipeline, wherein the washing machine further includes an external drainage pipeline for draining water to the outside, an inlet end of the external drainage pipeline is connected to the circulation filtration pipeline between the circulation pump and the filter device, and one of the filter device and the external drainage pipeline is connected with the circulation pump, during the washing process and/or the rinsing process, the filter device is connected with the circulation pump, after the washing process and/or the rinsing process is completed, the washing machine is configured to execute the sewage discharge operation, after the sewage discharge operation is completed, the circulation pump is connected with the external drainage pipeline, and the circulation pump is configured to run to drive water in the water holding barrel to be drained out of the washing machine through the external drainage pipeline.

* * * * *